US006796415B2

(12) United States Patent
Angove et al.

(10) Patent No.: US 6,796,415 B2
(45) Date of Patent: Sep. 28, 2004

(54) LOOSE COIN AND ROLLED COIN DISPENSER

(75) Inventors: John F. G. Angove, Indianapolis, IN (US); Rex A. Townsend, Indianapolis, IN (US); James D. Davenport, Pendleton, IN (US); Johnathon J. Meachum, Camby, IN (US)

(73) Assignee: AT Systems, Inc., Pasadena, CA (US)

( * ) Notice: Subject to any disclaimer, the term of this patent is extended or adjusted under 35 U.S.C. 154(b) by 0 days.

(21) Appl. No.: 10/626,473

(22) Filed: Jul. 23, 2003

(65) Prior Publication Data

US 2004/0117061 A1 Jun. 17, 2004

Related U.S. Application Data

(63) Continuation of application No. 09/692,802, filed on Oct. 20, 2000, now abandoned.

(51) Int. Cl.[7] ..... G07D 11/00
(52) U.S. Cl. ..... 194/206; 453/32
(58) Field of Search ..... 435/18, 19, 32; 194/206, 207; 221/129

(56) References Cited

U.S. PATENT DOCUMENTS

| | | | |
|---|---|---|---|
| 4,092,990 | A | 6/1978 | Bayne |
| 4,398,550 | A | 8/1983 | Shireman |
| 4,940,162 | A | 7/1990 | Thie |
| 5,002,516 | A | 3/1991 | Watanabe et al. |
| 5,615,759 | A | 4/1997 | Cadbury |
| 5,632,408 | A | 5/1997 | Mitchell |
| 5,695,038 | A | 12/1997 | Keith, III et al. |
| 5,725,081 | A | 3/1998 | Meeker |
| 5,813,510 | A | 9/1998 | Rademacher |
| 5,918,720 | A | 7/1999 | Robinson et al. |
| 6,003,652 | A | 12/1999 | Murata et al. |
| 6,039,164 | A | 3/2000 | Waters et al. |
| 6,067,530 | A | 5/2000 | Brooks, Jr. et al. |
| 6,109,416 | A | 8/2000 | Nickerson |

OTHER PUBLICATIONS

Autovend Incorporated, Autovend Revenue Management System RMS–1XL, brochure, Feb. 1991, 4 pages, Indianapolis, IN, USA.

Autovend, Incorporated, Autovend RMS–1 Smart Safe Revenue Management System, brochure, Sep. 1989, 4 pages.

Autovend, Incorporated, "Roadblock Against Temptation", brochure, 2 pages, Indianapolis, IN, USA.

Armor Safe Technologies, "Your Custom Requirements . . . Design Our Standard Product", brochure, 10 pages, Vista, CA, USA.

*Primary Examiner*—James R. Bidwell
(74) *Attorney, Agent, or Firm*—Christie, Parker & Hale, LLP

(57) ABSTRACT

An apparatus for dispensing cylindrical objects and loose coins having a case, a cylindrical object dispenser positioned inside of the case, a loose coin dispenser positioned inside of the case; and a central controller electronically coupled to the cylindrical object dispenser and the loose coin dispenser, the controller controlling both the operation of the cylindrical object dispenser and the operation of the loose coin dispenser.

17 Claims, 5 Drawing Sheets

LOOSE COIN AND ROLLED COIN DISPENSER

CROSS-REFERENCE TO RELATED APPLICATION(S)

This application is a continuation of application Ser. No. 09/692,802, filed Oct. 20, 2000, abandoned, which is incorporated herein by this reference.

BACKGROUND OF THE INVENTION

This invention relates to machines for dispensing currency, and more particularly to machines for dispensing both rolled and loose coins as well as bills contained in tubes.

Retail stores use a substantial amount of coins and small bills, e.g., ones, fives and tens, to make change throughout their business day. In most cases, the currency amounts of coins and small denomination bills given out as change substantially exceeds the amount of such coins and bills taken in. Consequently, such retail stores require a ready source of coins and small bills to replenish those given out as change.

Keeping a large supply of coins and small bills on hand is one way of solving the problem. However, this creates serious security problems. Retail establishments prefer to minimize the amount of cash accessible to the store attendant to reduce not only the amount of money which a robber might be able to get, but also to reduce the incentive to rob such establishments. A common practice therefore is to provide a locked device that the attendant cannot open and into which the attendant deposits cash receipts, keeping only a minimal amount in the cash register. However, minimizing the amount of cash to which the attendant has access increases the chances that the establishment will run out of change.

Often in these environments, retailers use time-delay cash control devices to minimize the amount of cash exposed in cash drawers. Retailers, particularly convenience stores and fast food restaurants, typically demand that cashiers have no more than $50.00 in their cash drawers at any time. Retailers typically deposit large denomination notes ($10, 20, 50, 100 bills) and dispense smaller denomination notes and coins ($1, 5, and all denominations of coin). Some states have legislated limits on convenience stores, such that stores may have no more than $20.00 exposed at certain times of the business day in order to provide a safer environment for employees.

One solution to this problem is disclosed in U.S. Pat. No. 4,940,162 to Thie. Thie teaches a dispenser for dispensing rolled coins and bills placed into tubes. However, the rolled coins used in Thie only come in particular quantities, such as a ten dollar roll of 40 quarters. Therefore, sometimes, a cashier has to withdraw a significant amount of money when all the cashier needs is a small amount. With the advent of the dollar coin, a new problem has emerged. U.S. banks have standardized on wrapping the new dollar coin in paper rolls, in quantities of $25; an amount that makes dispensing rolls of dollar coins dangerous because it dramatically increases the amount of cash in a drawer. Dispensing a $25 roll may be illegal in those states that allow no more than $20 exposed at certain times.

SUMMARY OF THE INVENTION

The present invention is an apparatus, which is a combination of a cylindrical object dispenser, and a loose coin dispenser, in a single case controlled by a central controller. In one embodiment of the present invention, the cylindrical object dispenser is designed to dispense rolled coins and paper currency placed in tubes. The controller is electrically connected to a display device for displaying information to a user. The controller is also electrically connected to a data entry device where a user can enter data and make transaction choices.

The case may also have a drop box located inside, with a drop slot located on the exterior of the case. Valuable goods such as checks, postage stamps, food stamps, and food coupons may be deposited inside of the drop box. Upon deposit of valuable goods in the drop slot, a value and description of the goods is entered into the data entry device.

The apparatus also has a printer for printing transaction receipts and reports. In another embodiment of the present invention, the apparatus has a bill reader electrically connected to the central controller. Bills received by the bill reader may be deposited within the apparatus and may be used to purchase rolled coins, paper currency placed in tubes, and loose coins.

In an additional embodiment, the apparatus also has a coin validator electrically connected to the central controller. Coins received by the coin validator are stored in a bin for later pickup. In an alternative embodiment, loose coins received by the coin validator are conveyed to an appropriate loose coin dispenser. Coins received by the coin validator may be deposited within the apparatus and may be used to purchase rolled coins, paper currency placed in tubes, and loose coins.

The case has an ejection slot where the cylindrical objects are dispensed. Within the slot for cylindrical object dispensation is an additional slot where the loose coins from the loose coin dispenser are dispensed. In an embodiment, the slot for loose coins is formed as a rounded cup, so that a user can scoop up the loose coins.

The apparatus can communicate with other devices such as an external printer, a point of sale machine, a bill reader, a coin validator, and a check validating device. The communication may be done through, for example, a serial, parallel, modem, network or satellite connection, or through the Internet.

BRIEF DESCRIPTION OF THE DRAWINGS

These and other features and advantages of the present invention will be better understood by reference to the following detailed description when considered with the accompanying drawings wherein.

DETAILED DESCRIPTION OF THE INVENTION

Figure 1:
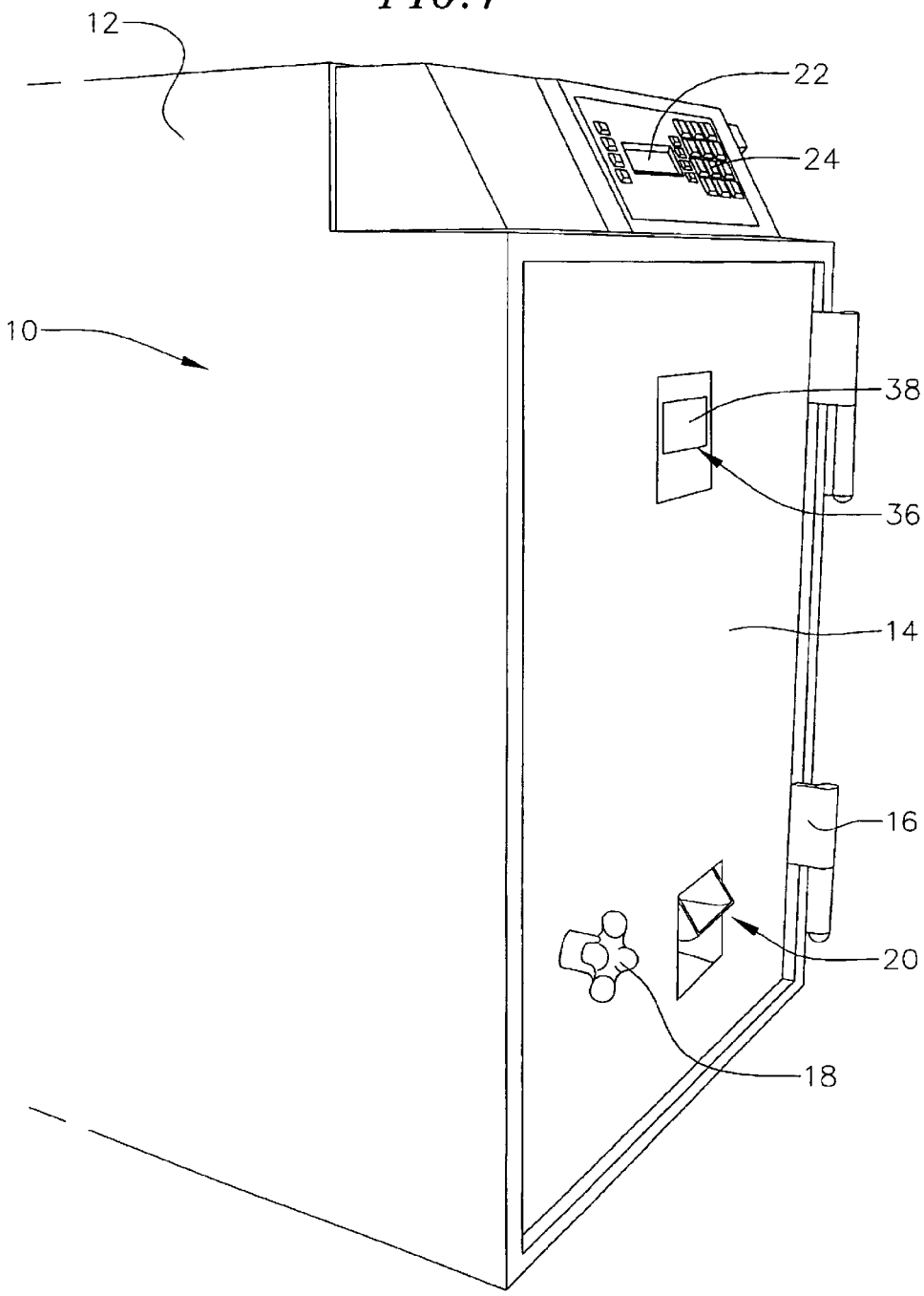
FIG. 1 is a photograph of the front of the apparatus according to an embodiment of the present invention.

An apparatus 10 for storing and dispensing money according to an embodiment of the present invention is shown in FIG. 1. As shown in FIG. 1, the apparatus 10 consists of a case 12. The case 12 is designed as a method of securing cash receipts, and intended to prevent unauthorized opening. The case has a front door 14 which provides access to the contents of the apparatus and which is, set on anti-tamper hinges 16. Mounted on the door 14 is a handle 18 which, in conjunction with an electronic lock, is used to open the door 14. Also mounted in the door, is a slot 20 where currency is dispensed. On top of the case 12 is mounted a display device 22 and a data entry device 24.

Figure 2:
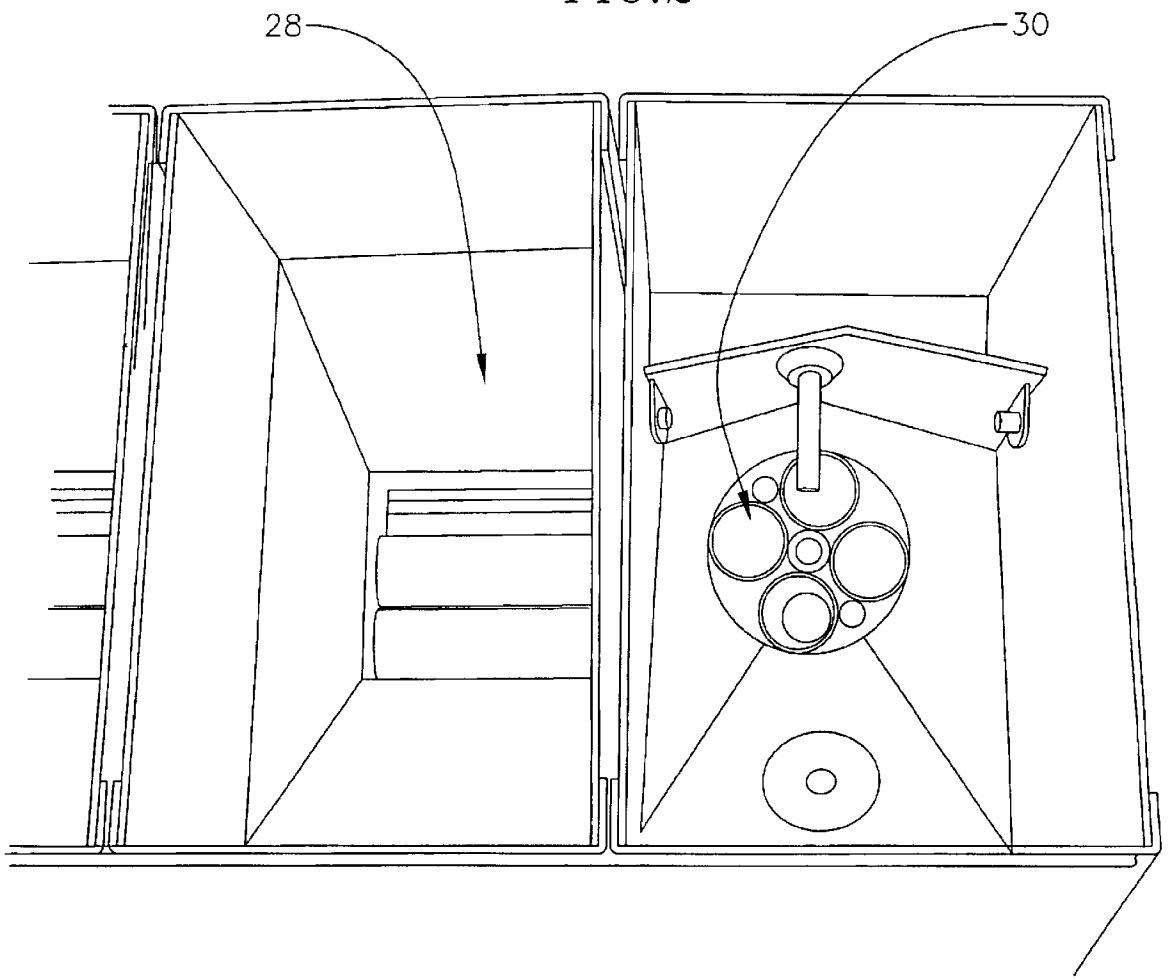
FIG. 2 is a top view photograph of mounted rolled and loose coin dispensers.

Inside of the case 12, as shown in FIG. 2, are mounted a plurality of different currency dispensers. A first type of currency dispenser is a rolled coin dispenser 28. The rolled coin dispenser 28 provides rolls of coins, or bills placed into tubes. One example of a coin dispenser 28 for rolled coins and tubed bills is described in U.S. Pat. No. 4,940,162 to Thie, the entire contents of which are incorporated herein by reference. More than one rolled coin dispenser may be used. In an embodiment, 6 different rolled coin dispensers are placed inside of the case 12.

Each rolled coin dispenser 28 may be configured to dispense a different type of coin or paper currency in a different quantity. For example, a rolled coin dispenser 28 may be configured to dispense rolls of 50 pennies, 40 nickels, 50 dimes, and 40 quarters, such quantities being standard in the US banking industry. Additionally, paper currency of different denominations and quantities can be placed in plastic tubes. For example, a tube may contain 5-$1 bills, 10-$1 bills, 5-$5, etc. As explained below, a user of the apparatus may configure the dispensers as they desire.

A second type of coin dispenser is mounted inside of the case 12. The second coin dispenser provides loose coins. One example of a loose coin dispenser 30 is described in U.S. Pat. No. 4,398,550 to Shireman, the entire contents of which are incorporated herein by reference. The loose coin dispenser may be configured to dispense a variety of different coins such as pennies, nickels, dimes, quarters, half-dollars, and dollars. In an embodiment of the present invention, the loose coin dispenser 30 is configured to dispense coins individually, depending on the total number of coins that a user desires. In an alternative embodiment, the loose coin dispenser 30 is configured to dispense a set number of coins, for e.g. 5 coins, every time a user requests loose coins. Multiple loose coin dispensers may be placed inside of the case 12 and used.

Each of the dispensers, both rolled coin and loose coin, are mounted onto a moveable platform. Preferably, the rolled coin and loose coin dispensers are of similar size and interchangeable with each other. The platform is moveably mounted on sliding rails. Once the door 14 has been opened, the platform may be pulled out of the front of the apparatus 10 to gain access to the dispensers. The platform contains a plurality of holes through which the currency dispensed from each dispenser passes. Beneath each hole of the platform is a chute which carries the dispensed currency.

Figure 3:
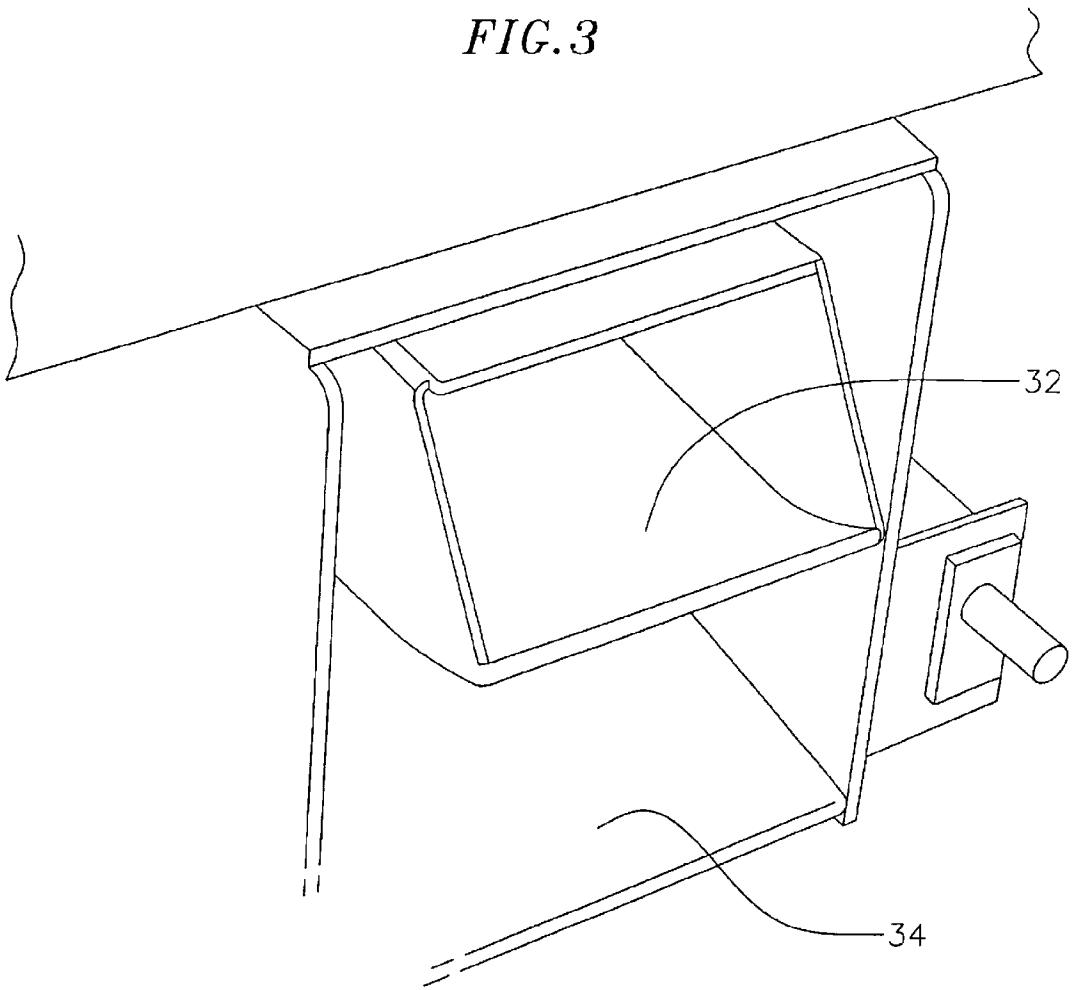
FIG. 3 is a photograph showing a rolled coin and tubed currency outflow slot and a loose coin outflow slot according to an embodiment of the present invention.

All of the rolled coin dispensers 28 are connected via chutes to a rolled coin outflow slot 32. All of the loose coin dispensers 30 are connected via chutes to a separate loose coin outflow slot 34. As shown in FIG. 3, the loose coin outflow slot 34 is positioned inside, and raised within, the rolled coin outflow slot 32. In an embodiment, the loose coin outflow slot 34 may be formed as a cup, where a user may reach in and scoop out the loose coins. The separation of loose coins from rolled coins and tubed currency makes it easier for a user to retrieve the currency that they requested.

Every dispenser, rolled coin and loose coin, is electronically connected to a central controller, where every transaction is controlled. The central controller is connected to the data display 22, where information about the contents of both the rolled coin and loose coin dispensers is displayed. The central controller is also connected to the data entry device 24, which provides a way for a user to select a transaction, such as obtaining rolled coins, tubed bills, or loose coins. In a preferred embodiment of the present invention, the data display and the data entry device are integrated in a touch screen.

The central controller may be incorporated into the cabinet 12. Alternatively, the central controller may be a remote device, electronically cabled or otherwise connected to the cabinet 12. The electronic circuitry of each loose coin dispenser is attached to a separate loose coin dispenser interface board. The loose coin dispenser interface board communicates instructions from the central controller to the loose coin dispenser, and information from the loose coin dispenser to the central controller.

In addition to the rolled coin and loose coin dispensers, the case may house a bill reader 36 that is also connected to the central controller. An example of a bill reader is described in U.S. Pat. No. 6,067,530 to Brooks, Jr. et al., the entire contents of which are incorporated herein by reference. As shown in FIG. 1, a bill insertion portion 38 of the bill reader 36 may be mounted in the door 14 of the case 12. The bill reader 36 allows a user to deposit currency into the apparatus, for storage and to pay for other types of rolled or loose coins and tubed bills.

A user places a bill into the bill reader and the bill reader 36 uses an optical detection method to determine the denomination of the bill, and whether the bill is not counterfeit. Once a bill has been accepted, the bill reader conveys the amount that has been entered to the central controller and stores the verified note inside the pedestal in a cassette. In the event that the bill reader cannot read a note, it will attempt to reject the note. On those occasions where the bill reader is unable to reject an unreadable note, the note will be stacked in the cassette and reported as "unrecognizable".

In an additional embodiment, the case houses a known coin validator, which allows for the entry of coins into the case, for deposit and to obtain other currency. Preferably, the coin validator is mounted on the platform adjacent to the rolled and loose coin dispensers. In one embodiment, the coin validator stores received coins in a removable container coupled to the validator. In an alternative embodiment, the coin validator separates the coins by denomination and sends one or more of the denominations to a present loose coin dispenser of that denomination. The conveyance of coins from the coin validator to the loose coin dispenser of that denomination allows the apparatus to operate for longer periods of time without being refilled.

Additionally, the casing may contain an envelope deposit. A user may deposit cash, checks, credit slips, food stamps, food coupons, or other valuable property into the envelope deposit for safe keeping. In an embodiment, the user communicates the contents of the envelope deposit to the central controller by using the data input device.

Additionally, in an embodiment, the central controller is connected to a printer for printing receipts for individual transactions, and for a variety of transaction reports. The receipts detail deposits, as well the dispensation of rolled coins, tubed bills, and loose coins. The reports can detail various different periods of time, for example, a shift, a day, or a period between armored car pickups.

Alternatively, the central controller may be connected to outside printers or processors, such as computers, for conveying transaction data. This connection may be in the form of a modem or other means known in the art, such as Internet and satellite interfaces. The connection may be used to update software on the central controller. The connection may also be used to diagnose and service problems with the apparatus.

Additionally, the apparatus may be part of a network. For example, the apparatus may be, connected to point of sale machines, automatic teller machines, currency validating machines, or other loose and rolled coin dispensers. The apparatus may also be connected to a check validating device that reads a check, contacts a bank, and verifies the validity of the check.

In one embodiment of the present invention, the central controller is connected to a data tracking system, such as another computer with a memory and a processor. The central controller sends data to the data tracking system via electronic file transmission, such as e-mail, at set intervals such as daily, weekly, monthly, etc., or upon the occurrence of specified events, such as armored car pickups. The e-mail sending mechanism of the controller will attempt to re-send the e-mail until reception is acknowledge by the data tracking system. An example the data tracking system is described in an Application Ser. No. 09/693,565, entitled "Electronic Transmission and Tracking of Deposit Information", filed Oct. 20, 2000, the entire contents of which are incorporated herein by reference.

In yet another embodiment, the central controller is coupled to other vending devices, such as stamp machines, phone card machines, and lottery ticket machines. This enables a user to enter a pin code or currency to obtain credit that can be used to obtain other valuable products, such as stamps and phone cards. This also allows the vending machines to be made separately, without bill readers, coin validators, and the central controller hardware and software.

Figure 4:
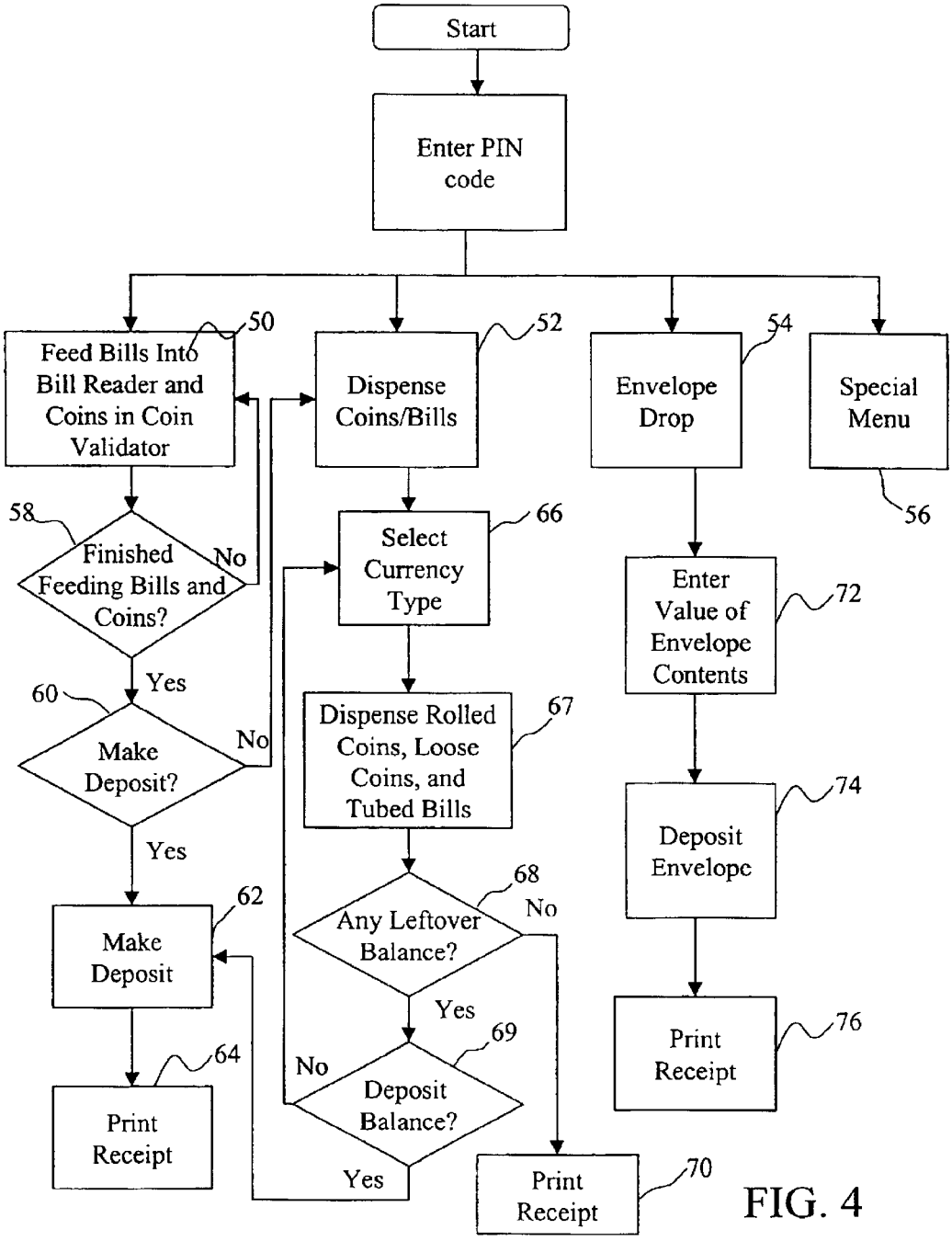
FIG. 4 is a flow chart showing the options and sequence of events presented to a user.
Figure 5:
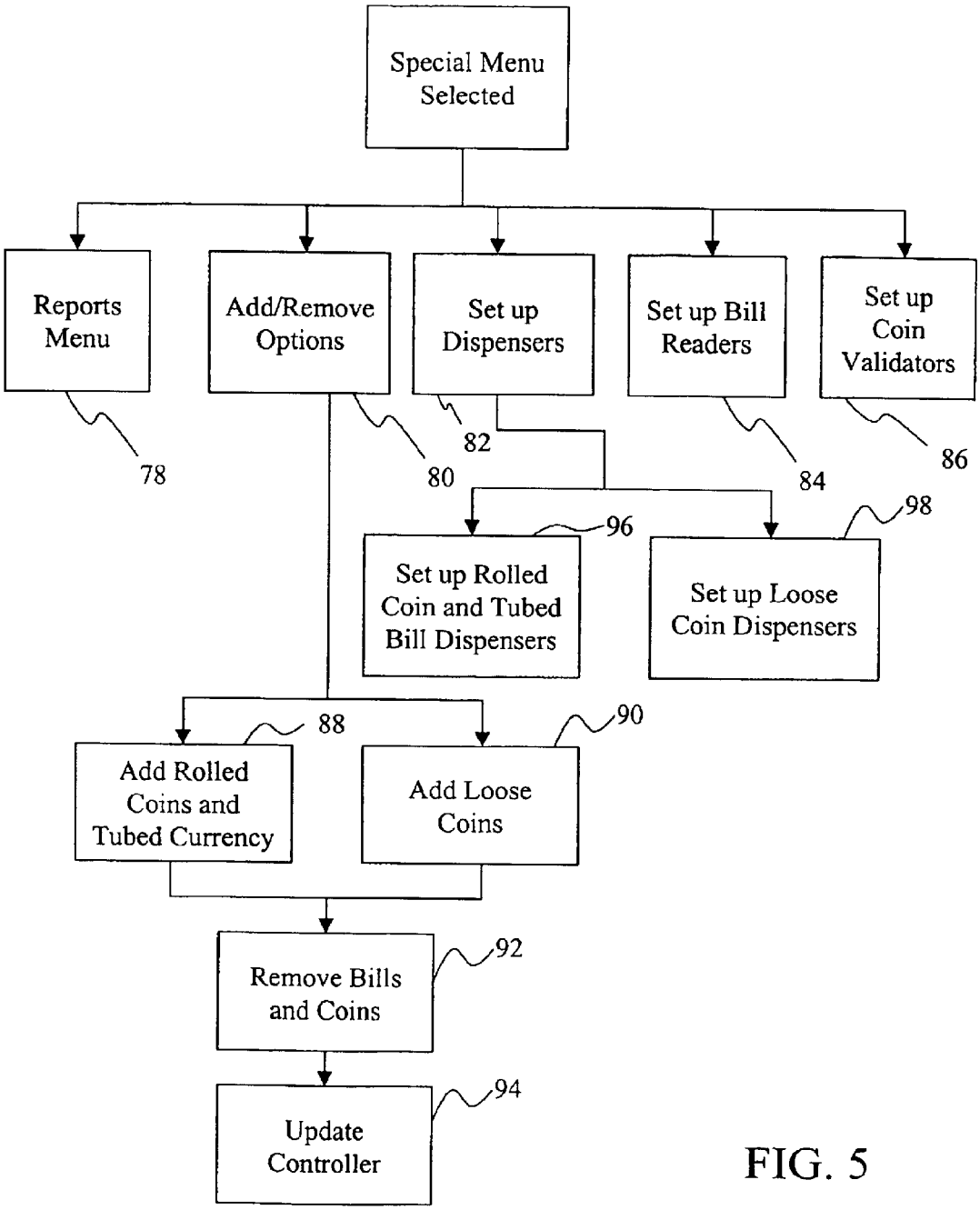
FIG. 5 is a flow chart showing additional options presented to a user.

FIG. 4 is a flow chart of a control algorithm for controlling the apparatus 10 according to an embodiment of the present invention in which a bill reader, coin validator, and envelope drop are present, and in which bills inserted into the bill reader and coins inserted into the coin validator may be used for deposits and for purchasing other currency. The control algorithm is run through the central controller.

The first step in the control algorithm is monitoring the data input device to see if an access code has been entered. If an access code has been entered, then the program places the code entered into a memory. The contents of the memory are then compared to preset codes stored in a memory of the central controller. A finite number of retries may be permitted to enter a valid access code to accommodate mistakes made when entering an access code.

If the access code is valid, then a number of menu choices are offered to a user via the display device. As seen in FIG. 4, the menu choices include access to the bill reader and coin validator (Box 50), rolled coin and loose coin dispensers (Box 52), and envelope drop (Box 54).

If the user selects to use the bill reader 36 and coin validator, the user is prompted to enter bills into the bill reader 36 and coins into the coin validator. In one embodiment, the user is allowed to enter bills into the bill reader 36, and coins into the coin validator, until the user pauses for a predetermined amount of time. In an alternative embodiment, the user is allowed to enter bills into the bill reader 36, and coins into the coin validator, until the value of the money entered exceeds the value of the currency obtainable from the apparatus. In yet another alternative embodiment, the user is allowed to enter bills into the bill reader 36, and coins into the coin validator, until the user presses a button on the control panel indicating that they are done entering bills and coins (Box 58).

Once the user has finished entering bills and coins, the total amount of credit the user has amassed is displayed for the user, and the user is prompted to either make a deposit or get other currency in return for the credit (Box 60). In an alternative embodiment of the present invention, the user is prompted to purchase other currency or coin with some of the credit, and deposit the remainder. If the user elects make a deposit, a deposit is entered (Box 62) and a receipt printed (Box 64).

If the user selects to dispense coins either from the main menu or after using the bill reader or coin validator, the user is prompted to select which types of currency to receive (Box 66). In one embodiment, the user is prompted to select pennies in $0.50 rolls, nickels in $2.00 rolls, dimes in $5.00 rolls, quarters in $10.00 rolls, four $5 bills rolled in a tube, five $10 bills in a tube, five $20 bills in a tube, or a quantity of $1 coins from the loose coin dispenser.

The dispensing currency, may be controlled by time-delay, so that only a certain amount of a particular currency denomination may be dispensed within a particular time frame. The time-delay may be varied by time of day and by denomination. If too many items have not been dispensed, then a signal is sent to the dispenser to dispense the requested currency (Box 67). Following the transmission of the request signal, a check is made to ensure that the dispenser selected is not jammed or otherwise signaling an error. If the controller receives a signal from the dispenser counter sensor for the selected dispenser within a given time period, such as sixteen seconds, no time out error has occurred and a check is then made to see if the vend is complete. If no such signal has been received, a time out error has occurred which indicates that the selected dispenser has been actuated long enough to dispense an article, but has not. This indicates the selected dispenser has experienced a problem, such as jamming, and an error message is displayed. If the vend is incomplete, the vend menu is displayed again, and a user is prompted to select another denomination of currency. If the vend is complete, the motor of the dispenser is shut off. The success or failure of the transaction is saved for later printing on a receipt.

Following the success of a transaction, the controller determines if the user has a credit balance (Box 68). If the user has remaining credit, then the user is prompted to either deposit the credit or dispense other coins (Box 69). If the user elects to deposit the credit, the control algorithm proceeds to the deposit steps explained above (Box 60). If the user elects not to deposit the credit, then the user is again prompted to select a denomination of currency to be dispensed (Box 66). If the user does not have any remaining credit, a receipt is printed (Box 70), and the control sequence is reset.

With regard to any loose coin dispensers, a loose coin dispenser interface board (CIB) controls and monitors the progress of each loose coin dispenser. The central controller sends a command to a CIB corresponding to a dispenser of the particular type of loose coin requested by a user. The central controller instructs the CIB to have the loose coin dispenser dispense a specified number of coins. At the same time as the instruction is communicated to the CIB, the central controller initiates a timer.

The CIB stores the specified number of coins in a memory and starts the motor of the corresponding loose coin dispenser. After starting the motor, the CIB monitors an output signal on the loose coin dispenser for a pulse. Each pulse detected indicates a coin dropped, and each time a pulse is detected the CIB increments a counter. After incrementing the counter, the CIB compares the value of the counter to the specified number of coins stored in memory.

If the counter is equal to the specified number of coins, the CIB turns off the motor of the loose coin dispenser, places a value indicating success in a status-variable, and places the value in the counter into a counter-variable. Alternatively, if there is an error, then the CIB, places a value in the status-variable indicating the particular error, and then places the value in the counter into the counter-variable. The next time the central controller polls the CIB to determine the progress of the dispenser, the CIB communicates the status-variable and the counter-variable. Once communicated, the value of the status-variable and the counter-variable tell the central controller the status of the loose coin dispensing operation, and allow the central controller, to report the status to the user.

If for some reason the CIB, or the loose coin dispenser associated with the CIB, is not responding, then no values are placed in the status-variable and the counter-variable.

Therefore, every time that the central controller polls the CIB, no values are returned. After the central controller timer reaches a pre-selected amount of time with no response from the CIB an error is presumed, and the apparatus is set to "not available."

If the user selects access to the envelope drop, the user is prompted to enter the value of the items in the envelope to be deposited (Box 72). The user then deposits the envelope through the envelope deposit (Box 74). Following the conclusion of the deposit, a receipt is printed (Box 76). In an alternative embodiment, the value and nature of the items to be deposited is entered and a receipt printed. The user then attaches the receipt to the envelope or places the receipt in the envelope with the items to be deposited. The user then deposits the envelope through the envelope deposit.

In one embodiment, a hierarchy of users exists so that some users are not given access to advanced options, some users are given access to a limited group of advanced options, and some users are given access to all advanced options. From within the advanced options menu, the user can choose, for example, to print reports (Box 78), add or remove coin or currency items (Box 80), setup the dispensers (Box 82), setup the bill reader (Box 84), and setup the coin validator (Box 86).

If the user selects the add or remove items option, then the user opens the door 14 to the case 12 to gain access to the rolled coin and loose coin dispensers and any deposited items. After opening the door, the user slides the dispensers out of the case and add currency to them. The user adds rolled coins and currency rolled in tubes to the cylindrical object dispenser (Box 88), and loose coins to the loose coin dispensers (Box 90). The user may also remove bills from the bill reader, coins from the coin validator, and deposited items from the deposit box (Box 92). After adding and removing currency, the user enters, through the data entry device, the amount added to and removed from each dispenser for tracking purposes (Box 94). This allows the controller to later subtract the amount of currency dispensed from each dispenser and provide a user with the amount of currency left in each dispenser.

Access to the door of the apparatus may be time controlled, so that the door cannot be opened during a particular time of day. Alternatively, a delay may be used so that the door will not open until a pre-specified period of time has elapsed from the time at which the add/remove items request was made. The timers may be disabled for certain events, such as an armored car pickup.

In one embodiment of the present invention, armored car personnel enter a special pin code for access to the apparatus. The armored car pin code tells the system to disable the timers. In an additional embodiment, both the armored car pin code, and another user pin code must be entered to switch off the door timers and gain immediate access to the apparatus. By using special pin codes and procedures for armored car pickups, the central controller may track when the armored car pickup occurred and use that tracking data to create additional reports.

If the user elects to set up the dispensers, the user is prompted to configure each of the dispensers in the apparatus. Each dispenser is assigned a unique position within the case. The user is prompted to enter information about a dispenser at each position. The user is prompted to select the denomination of currency that is dispensed from the rolled coin and loose coin dispensers and the quantity that the currency is dispensed in. (Boxes 96 and 98). In one embodiment, a user may pre-select a quantity of loose coins to be dispensed by the loose coin dispenser in each activation of the loose coin dispenser.

If the user elects to set up the bill reader, the user is prompted to configure whether bills accepted from the reader will be used for change, for deposit, or both. The user is also prompted to select the types of bills that the reader can accept. The user is also prompted to enter the number of bills that can be stored in the bill reader before an alert is generated, and before the bill reader is disabled.

If the user elects to set up the coin validator, the user is prompted to configure whether coins accepted from the coin validator will be used for change, for deposit, or both. The user is also prompted to select the types of coins that the coin validator can accept.

In an embodiment of the present invention, a hierarchy is created wherein a supervisor can edit the accounts of the people under them, but not other supervisors, or people above them in the hierarchy. A supervisor can elect to edit the properties of users. If the high level user elects to edit users, the supervisor can add, edit, or delete users and the properties assigned to them.

As the next step in the control algorithm, a counter error check is made to ensure that items are not being dispensed when the dispensers are not in the vend mode. If a signal from a count sensor of any of the dispensers is received when that dispenser is not in the vend mode, the signal indicates that the dispenser has failed because the dispenser is dispensing items when no request has been made for those items. If the counter error check is positive, a "drop by unknown user" message is displayed and printed. If the counter error check is negative, the control sequence returns to the step of monitoring the data input device.

In an additional embodiment of the present invention, the central controller may be connected to burglary and smoke alarms. The central controller runs under battery backup, so that in the event of a power shortage data is protected and some functionality, such as armored car pickup may be enabled. The central controller may also be coupled to known authentication devices such as finger print identification, iris sensing, and magnetic card sensing machines.

The preceding description has been presented with reference to presently preferred embodiments of the invention. Workers skilled in the art and technology to which this invention pertains will appreciate that alterations and changes in the described apparatus may be practiced without departing from the principal, spirit and scope of this invention.

Accordingly, the foregoing description should not be read as pertaining only to the precise apparatus described and illustrated in the accompanying drawings, but rather should be read consistent with and as support to the following claims which are to have their fullest and fair scope.

What is claimed is:

1. An apparatus for dispensing cylindrical objects and loose coins comprising:

a case;

a cylindrical object dispenser positioned inside of the case;

a loose coin dispenser positioned inside of the case;

a central controller electronically coupled to the cylindrical object dispenser and the loose coin dispenser, the controller controlling both the operation of the cylindrical object dispenser and the operation of the loose coin dispenser; and a loose coin dispenser interface board between the central controller and the loose coin dispenser to receive a signal from the central controller and to control and monitor the loose coin dispenser.

2. The apparatus of claim 1 further comprising loose coins and at least one of the group consisting of rolled coins and paper currency placed in tubes; and wherein the cylindrical object dispenser dispenses at least one of a group consisting of rolled coins and paper currency placed in tubes.

3. The apparatus of claim 1 further comprising a data display device electrically connected to the central controller; wherein the display device displays data from the central controller.

4. The apparatus of claim 3 further comprising a data entry device electrically connected to the central controller; wherein the data entry device provides data entry and communication of data to the central controller.

5. The apparatus of claim 4 wherein the display device and the data entry device are a touch screen.

6. The apparatus of claim 4 further comprising a drop slot and drop box, wherein the drop box is located inside of the case and wherein goods are deposited through the drop slot into the drop box.

7. The apparatus of claim 6 further comprising a printer coupled to the central controller for printing data.

8. The apparatus of claim 7 further comprising a bill reader electrically connected to the central controller.

9. The apparatus of claim 8 wherein bills received by the bill reader are deposited within the apparatus.

10. The apparatus of claim 9 wherein bills received by the bill reader are used to purchase at least one of the group consisting of rolled coins, paper currency placed in tubes, and loose coins.

11. The apparatus of claim 10 further comprising a coin validator electrically connected to the central controller.

12. The apparatus of claim 11 wherein the coin validator conveys entered coins to the loose coin dispenser.

13. The apparatus of claim 11 wherein coins received by the coin validator are deposited within the apparatus.

14. The apparatus of claim 11 wherein currency received by the bill reader is used to purchase at least one of the group consisting of rolled coins, paper currency placed in tubes, and loose coins.

15. An apparatus for dispensing cylinder objects and loose coins comprising:

a case;

a cylindrical object dispenser positioned inside of the case;

a loose coin dispenser positioned inside of the case; and a central controller electronically coupled to the cylindrical object dispenser and the loose coin dispenser, the controller controlling both the operation of the cylindrical object dispenser and the operation of the loose coin dispenser comprising a first ejection slot in the case where items dispensed by the cylindrical object dispenser are ejected; and at least one additional ejection slot where coins dispensed by the loose coin dispenser are retrievable, wherein at least one of the first ejection slot and the additional ejection slot are positioned one within the other.

16. The apparatus of claim 1 further comprising communications means for communicating data between the central controller and at least one of the group consisting of: an external printer, a point of sale machine, a bill reader, a coin validator, and a check validating device.

17. The apparatus of claim 16 wherein the communications means is a modem.

* * * * *